US005370307A

United States Patent [19]

Uehra

[11] Patent Number: 5,370,307

[45] Date of Patent: Dec. 6, 1994

[54] AIR CONDITIONER HAVING HIGH HEATING CAPACITY

[75] Inventor: Yuzuru Uehra, Ann Arbor, Mich.

[73] Assignee: Gas Research Institute, Chicago, Ill.

[21] Appl. No.: 948,635

[22] Filed: Sep. 23, 1992

[30] Foreign Application Priority Data

Mar. 25, 1991 [JP] Japan ..... 3-60594

[51] Int. Cl.[5] ..... G05D 23/00

[52] U.S. Cl. ..... 237/2 B; 62/222; 62/512

[58] Field of Search ..... 62/512, 324.1, 324.4, 62/238.6, 197, 225, 205, 516, 323.1, 323.2, 323.3; 237/2 B

[56] References Cited

U.S. PATENT DOCUMENTS 5,020,320 6/1991 Talbert et al. ..... 237/2 B 5,056,329 10/1991 Wilkinson ..... 62/512

5,174,123 12/1992 Erickson ..... 62/323.1 X

OTHER PUBLICATIONS

Service Manual of the Heat-pump Type Air Conditioner (issued by Aisin Seiki Co., Ltd. in Jul., 1989).

*Primary Examiner*—Henry A. Bennet

*Attorney, Agent, or Firm*—Burns, Doane, Swecker & Mathis

[57] ABSTRACT

An air conditioner has a heating capacity which is increased with a compressor driven by an engine when an outdoor temperature is too low. A work load of the compressor is increased by injecting refrigerant into the compressor via an injecting port. As a result, a load of the engine is also increased so that a coolant temperature is also increased. A large heat radiation from the hot coolant to the indoor air is established at a coolant heat exchanger.

8 Claims, 7 Drawing Sheets

AIR CONDITIONER HAVING HIGH HEATING CAPACITY

BACKGROUND OF THE INVENTION

1. Field of the Invention

The present invention relates to an air conditioner having a high heating capacity, and more particularly to an air conditioner, with a compressor driven by an engine, having a high heating capacity, 2. Description of the Related Art A conventional air conditioner, whose compressor is driven by an engine as shown in FIGS. 7 and 8, is disclosed in the Service Manual of the Heat-pump type air conditioner (issued by Aisin Seiki Co., Ltd. in July, 1989). Referring to FIG. 7, when a user turns on a switch (not shown), the air conditioner 500 is driven. An engine 510 is started and a compressor 530 is driven. A vapor refrigerant is discharged from the compressor 530, and flows into an indoor heat exchanger 531 via an oil separator 532 and a reversing valve 533. The indoor heat exchanger 531 is located in an indoor unit 534. An indoor air flow is generated in the indoor unit 534 by a fan 535. Heat radiation from the refrigerant to the indoor air is established, and the indoor air becomes hot. Further, the vapor refrigerant condenses into liquid refrigerant.

After that, the liquid refrigerant flows into an expansion valve 536 via a receiver 537. The opening ratio of the expansion valve 536 is regulated by a temperature detecting tube 538, so that all of the liquid refrigerant flowing into the first expansion valve 536 does not flow therethrough. Thus, one part of the liquid refrigerant is temporarily kept in the receiver 537.

When the liquid refrigerant flows through the first expansion valve 536, the liquid refrigerant expands and changes into liquid and vapor refrigerant. Next, the liquid and vapor refrigerant flows into an outdoor heat exchanger 539. The outdoor heat exchanger 539 is located in an outdoor unit 540. An outdoor air flow is generated in the outdoor unit 340 by a fan 541. Here, heat transfer from the outdoor air to the refrigerant is established, and the liquid and vapor refrigerant evaporate completely. This complete evaporation of the liquid and vapor refrigerant is ensured by the regulation of the opening ratio of the expansion valve 536. After that, the vapor refrigerant flows into the compressor 530 via the reversing valve 533 and an accumulator 542.

Referring to FIG. 8, a coolant discharged from a water pump 550 flows through the engine 510 and into an exhaust heat exchanger 551, thus increasing a temperature of the coolant. Next, the hot coolant flows into a hot coolant heat exchanger 552. Here, heat radiation from the hot coolant to the indoor air is established, and the indoor air becomes hot, too. Therefore, the room (not shown) is heated by the refrigerant and the hot coolant.

When the outdoor temperature is too low, an evaporating temperature and an evaporating pressure of the liquid and vapor refrigerant in the outdoor heat exchanger 539 become low. Further, density of the vapor refrigerant which is sucked into the compressor 530 becomes low and mass flow of the refrigerant in a heat-pump circuit becomes little. As a result, the quantity of the heat transfer from the outdoor air to the refrigerant becomes low, and a quantity of the heat radiation from the refrigerant to the indoor air decreases. On the other hand, the work load of the compressor 530 decreases.

That is, the work load decreases since a suction pressure of the compressor 530 is relatively low. As a result, the load of the engine 510 decreases according to the decreasing of the work load of the compressor 530, and a temperature of the coolant decreases, so that a quantity of the heat radiation from the hot coolant to the indoor air at the hot coolant heat exchanger 552 decreases. Thus, the heating capacity according to the refrigerant and the coolant of the air conditioner 500 decreases.

SUMMARY OF THE DISCLOSURE

Accordingly, it is a primary object of the present invention to increase a heating capacity of an air conditioner when an outdoor temperature is too low.

The above and other objects are achieved according to the present invention by an air conditioner having a high heating capacity. The air conditioner comprises a heat pump circuit having a compressor, an indoor heat exchanger, a receiver, a first expansion valve, and an outdoor heat exchanger. The compressor is driven by an engine and has a suction port, discharging port, an injection port, a rotor and vanes, a first detecting means regulating an opening ratio of the first expansion valve, refrigerant circulating in the heat pump circuit, an injection means injecting one part of the refrigerant into the injection port, a coolant circuit of the engine, and a hot coolant heat exchanger located in the coolant circuit for increasing a heating capacity of the air conditioner.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawing, wherein.

DETAILED DESCRIPTION OF THE PREFERRED EMBODIMENTS

Figure 1:
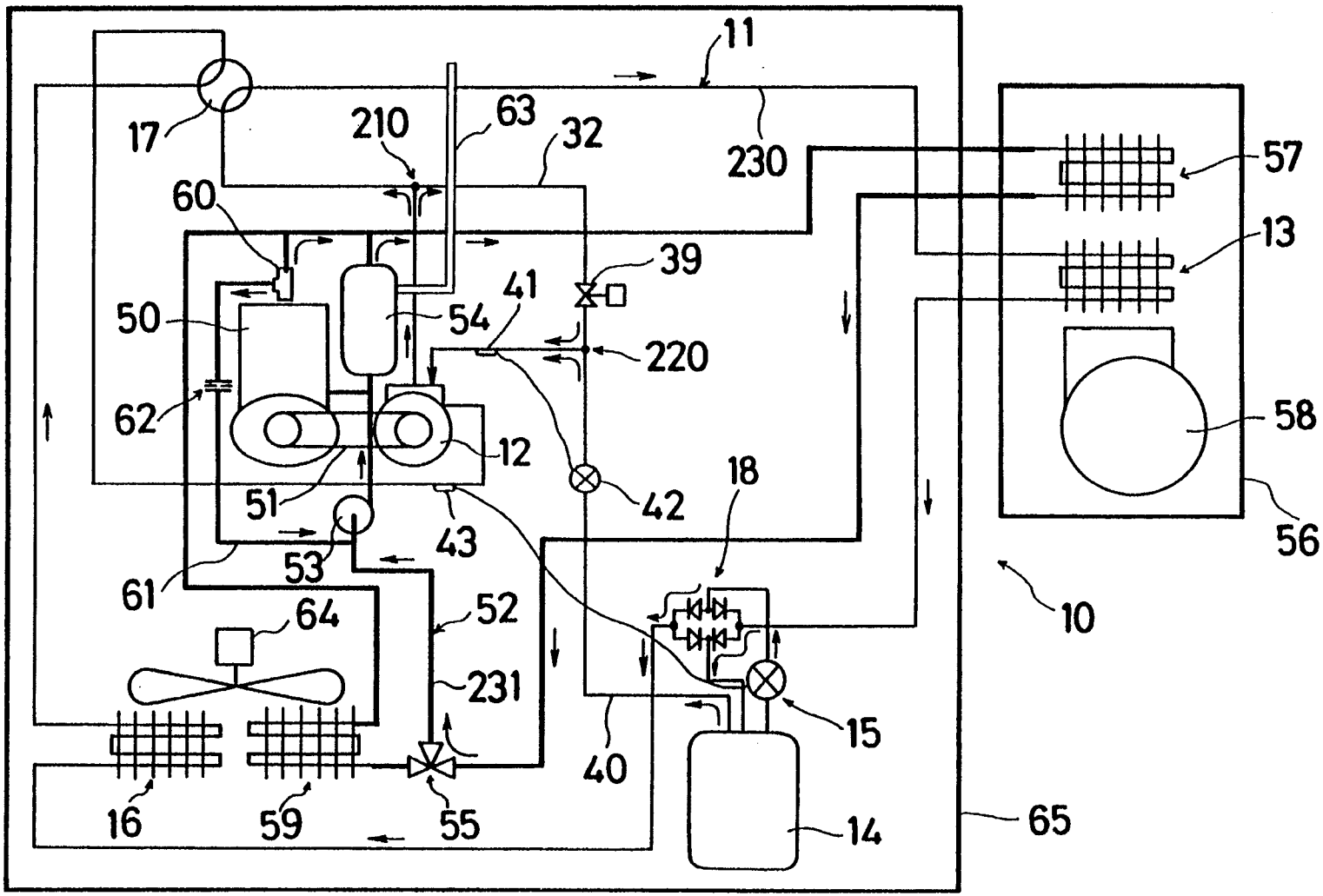
FIG. 1 shows a heat pump circuit and a coolant circuit of an air conditioner according to the first embodiment of the invention.

Referring to FIG. 1, an air conditioner 10, according to the first embodiment of the present invention, is shown. FIG. 1 shows a heating mode of the air conditioner 10. Though the air conditioner 10 is designed to act in both the heating mode and a cooling mode, the subject matter of the present invention relates to the heating mode. Therefore, the following description is directed only to the heating mode.

A heat pump circuit 11 of the air conditioner 10, which has therein a refrigerant path 230, comprises a compressor 12, an indoor heat exchanger 13, a receiver 14, a first expansion valve 15, and an outdoor heat exchanger 16. Further, the heat pump circuit 11 comprises a reversing valve 17 and a bridge 18 for changing from the heating mode to the cooling mode, and vice versa. The bridge 18 includes a combination of four one-way valves. The indoor heat exchanger 13 acts as a condenser and the outdoor heat exchanger 16 acts as an evaporator, and refrigerant circulates in the heat pump circuit 11.

An opening ratio of the first expansion valve 15 is regulated according to a superheating ratio of the refrigerant detected by a temperature detecting tube 43. The temperature detecting tube 43 constitutes a first detecting means. The temperature detecting tube 43 is located at an upstream side of suction ports 19,33 of the refrigerant path 230.

Figure 2:
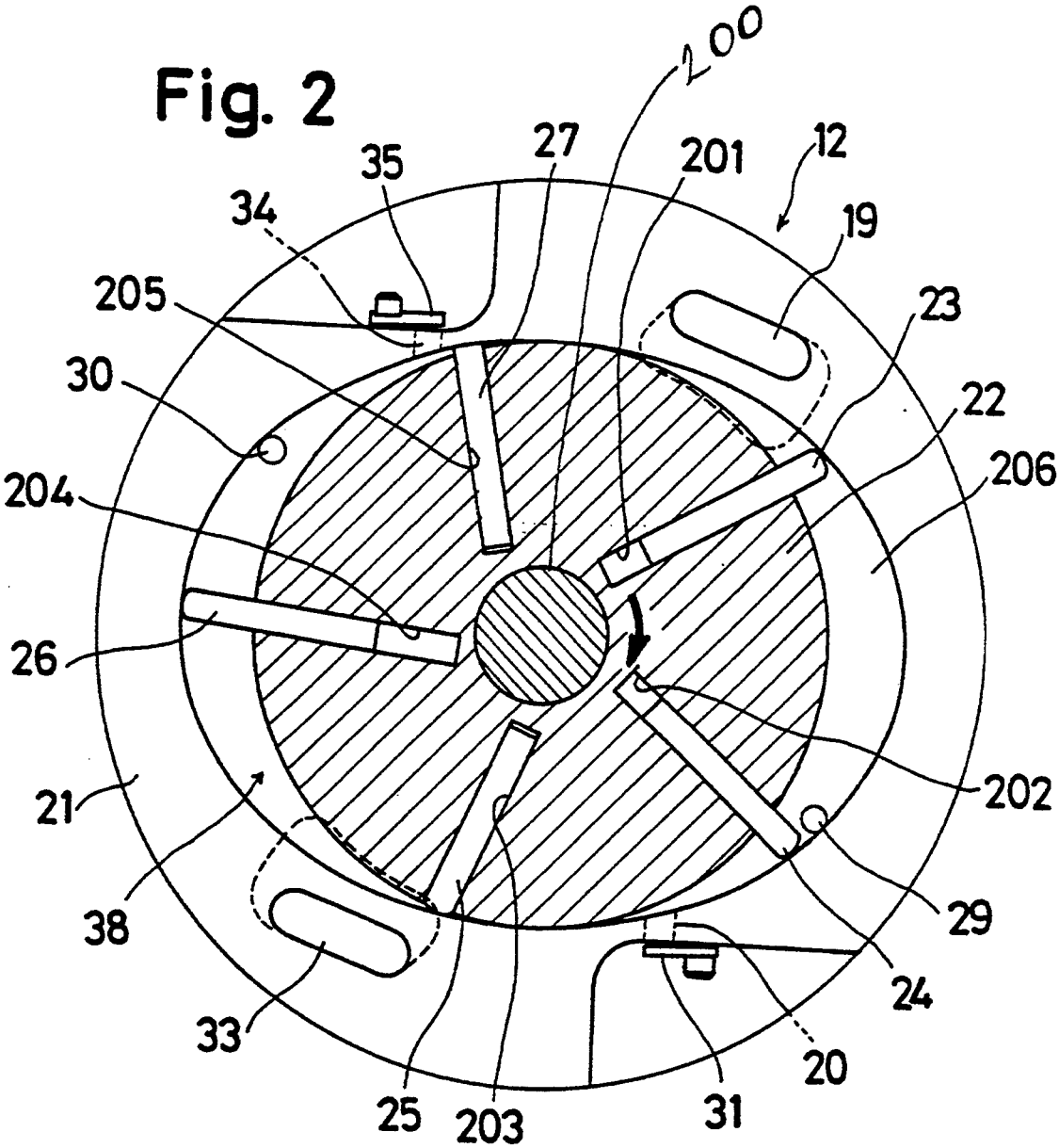
FIG. 2 is an elevation, partly in section, of a compressor shown in FIG. 1.

The compressor 12, shown in FIG. 2, is preferably a multi-vane rotary type compressor. The compressor 12 comprises two compressing circuits. That is, two suction ports 19,33, two discharging ports 20,34, two injection ports 29,30, and two reed valves 31,35 are formed or located in a housing 21 of the compressor 12. The two compressing circuits are used for only one heat pump circuit 11 in common. A rotor 22 fixed to a shaft 200 is located in a room 206 formed in the housing 21 and is driven or rotated. Vanes 23,24,25,26,27 are located in slits 201,202,203,204,205, respectively, formed in the rotor 22. Each of the outer end of the vanes 23,24,25,26,27 contacts with an inner surface of the room 206 continually since each of the vanes 23,24,25,26,27 is biased outwardly in the radial direction of the rotor 22. As shown in FIG. 2, it is desirable that the injection port 29(30) is located in a spot where the injection port 29(30) begins to open just after the suction process has been completed. Further, a diameter of the injection port 29(30) is preferably smaller than a width of the vane 23(24,25,26,27).

The compressor 12 may be not only of the multi-vane rotary type compressor, but also a reciprocating type compressor or a scroll type compressor. Namely, the compressor should preferably have the injection port located in a spot where the injection port begins to open just after the suction process has been completed.

Figure 3:
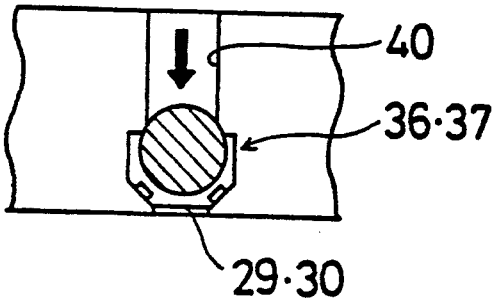
FIG. 3 is a cross section of a one-way valve used for the compressor of FIG. 2.
Figure 4:
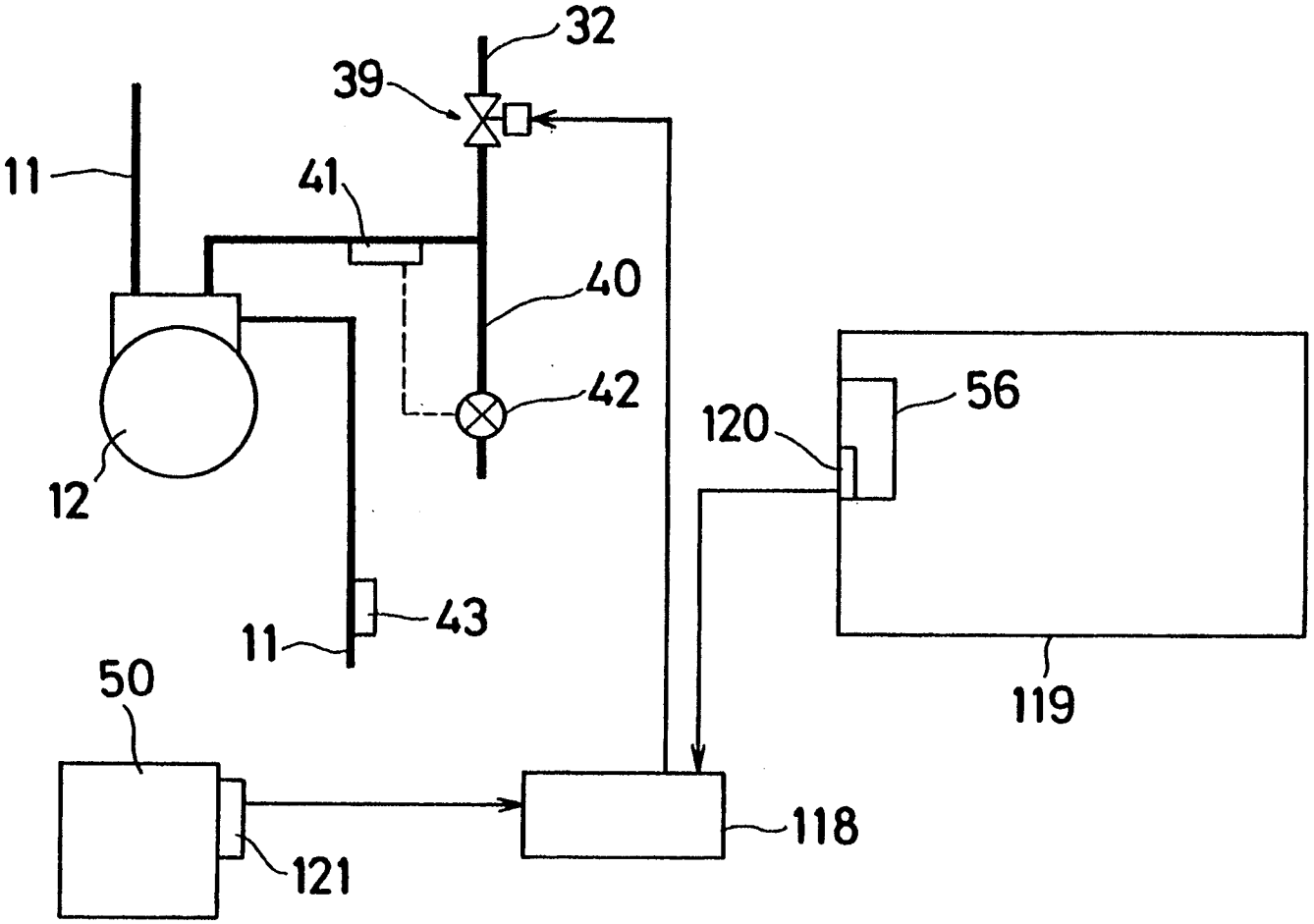
FIG. 4 is a schematic diagram of part of the heat pump circuit.

A first injection path 32 connects a diverging point 210 on the refrigerant path 230 with the injection ports 29,30. The diverging point 210 is located between the discharging ports 20,34 and a reversing valve 17. At connecting points between the first injection path 32 and each of the injection ports 29,30, a respective one-way valve 36,37, shown in FIG. 3, is located. Thus, refrigerant flows only from the first injection path 32 into the room 206. A regulating valve 39 is located in the first injection path 32. The regulating valve is preferably a solenoid valve (not shown). The regulating valve 39 controls proportionally an amount of flowing refrigerant. An opening ratio of the regulating valve 39 is controlled by an electric control unit 118, shown in FIG. 4. Further, a signal from a thermostat 120 and a signal from a throttle opening ratio sensor 121 are at least inputted to the electric control unit 118. The thermostat 120 is located in an indoor unit 56 which is located in a room 119. The throttle opening ratio sensor 121 detects a throttle opening ratio of an engine 50 which drives the compressor 12 via a belt 51.

A second injection path 40 connects the receiver 14 and a connecting point 220 on the first injection path 32. A second expansion valve 42 is located in the second injection path 40. An opening ratio of the second expansion valve 42 is regulated according to a superheating ratio of the refrigerant detected by a temperature detecting tube 41. The temperature detecting tube 41 constitutes a second detecting means. The connecting point 220 is located at an upstream side of the temperature detecting tube 41. The temperature detecting tube 41 is located in the first injection path 32 between the injection ports 29,30 and the connecting point 220.

Each opening ratio of the first expansion valve 15 and the second expansion valve 42 are regulated by the temperature detecting tubes 43,41, respectively, in this embodiment. Namely, each of the first expansion valve 15 and the second expansion valve 42 is a mechanically regulated valve. However, each opening ratio of the first expansion valve 15 and the second expansion valve 42 may be regulated by respective temperature sensors (not shown) instead of the temperature detecting tubes 43,41 via the electric control unit 118.

The above-mentioned components of the heat pump circuit 11 are located in an outdoor unit 65 except for the indoor heat exchanger 13. The indoor heat exchanger 13 is located in the indoor unit 56.

A water pump 53 is located in a coolant path 231 of a coolant circuit 52 of the engine 50. Coolant discharged from the water pump 53 flows into both the engine 50 and an exhaust heat exchanger 54. The exhaust heat exchanger 54 is located in an exhaust pipe 63 of the engine 50. After that, the coolant, whose temperature increases, flows through a hot coolant heat exchanger 57 located in the indoor unit 56 via a three-way valve 55. When the temperature of the coolant becomes abnormally high, the hot coolant flows into a radiator 59 via the three-way valve 55. The three-way valve 55 is controlled by the electric control unit 118, since a signal representing the temperature of the coolant is inputted to the electric control unit 118. A thermostat 60, a bypass path 61, and an orifice 62 are located in the coolant circuit 52.

The above-mentioned components of the coolant circuit 52 are located in the outdoor unit 65, except for the hot coolant heat exchanger 57. The hot coolant heat exchanger 57 is located in the indoor unit 56.

In the indoor unit 56, a fan 58 is located and is set to establish more effective heat exchange between indoor air flowing through the indoor unit 56 and the refrigerant flowing through the indoor heat exchanger 13, and between the indoor air and the coolant flowing through the hot coolant heat exchanger 57. In the outdoor unit 65, a fan 64 is located and is set to establish more effective heat exchange between outdoor air flowing through the outdoor unit 65 and the refrigerant flowing through the outdoor heat exchanger 16, and between the outdoor air and the coolant flowing through the radiator 59.

In the above air conditioner 10, when a user turns on a switch (not shown) of thermostat 120, the air conditioner 10 is driven. First, the engine 50 is started and the compressor 12 is driven. The vapor refrigerant, which is under a high pressure and at a high temperature, is then discharged from the compressor 12 via the discharging port 20,34. The electric control unit 118 controls to close the regulating valve 39 completely. The vapor refrigerant flows into the indoor heat exchanger 13 via the reversing valve 17. Here, heat exchange between the vapor refrigerant and the indoor air is established, so that heat radiation from the refrigerant to the indoor air is established, and the indoor air becomes hot.

Further, the vapor refrigerant condenses into liquid refrigerant which is under a high pressure and at a high temperature. At the same time, heat exchange between the hot coolant flowing through the hot coolant heat exchanger 57 and the indoor air is established, so that heat radiation from the hot coolant to the indoor air is established, and the indoor air is further heated. In that manner, the room 119 is heated by the refrigerant and the hot coolant.

After that, the liquid refrigerant flows into the first expansion valve 15 via the bridge 18 and the receiver 14. The ratio of the first expansion valve 15 is regulated by the temperature detecting tubes 43, so that all of the liquid refrigerant flowing into the first expansion valve 15 does not flow therethrough. Thus, one part of the liquid refrigerant is temporarily kept in the receiver 14.

When the liquid refrigerant flows through the first expansion valve 15, the liquid refrigerant expands and changes into liquid and vapor refrigerant which is under a low pressure and at a low temperature. Next, the liquid and vapor refrigerant flows into the outdoor heat exchanger 16 via the bridge 18. Here, heat exchange between the liquid and vapor refrigerant and the outdoor air is established, so that heat is transferred from the outdoor air to the refrigerant, and the liquid and vapor refrigerant evaporates completely. This complete evaporation of the liquid and vapor refrigerant is ensured by the regulation of the opening ratio of the first expansion valve 15. After that, the vapor refrigerant flows into the compressor 12 via the reversing valve 17 and the suction ports 19,33.

This is one cycle of the heat pump circuit 11, and the room 119 is continuously heated by the repetition of the cycle. The heating capacity of the air conditioner 10 is regulated in such a manner that the speed of the engine 50 is regulated by the electric control unit 118.

When the outdoor temperature is below a certain level, an evaporating temperature and an evaporating pressure of the liquid and vapor refrigerant in the outdoor heat exchanger 16 become low, and the work load of the compressor 12 decreases. The work load is shown at portion "A" in FIG. 5, and a Pressure-Volume relationship in this condition is shown at line 70. P2 represents the discharge pressure of the compressor 12 without any injection through the injection ports 29, 30. That is, the work load decreases since a suction pressure P1 of the compressor 12 is relatively low. As a result, a quantity of the heat radiation from the refrigerant to the indoor air decreases. Further, a load of the engine 50 decreases according to decreasing of the work load of the compressor 12, and a temperature of the coolant decreases, so that a quantity of the heat radiation from the hot coolant to the indoor air at the hot coolant heat exchanger 57 decreases. Thus, the heating capacity of the air conditioner 10 decreases.

Figure 5:
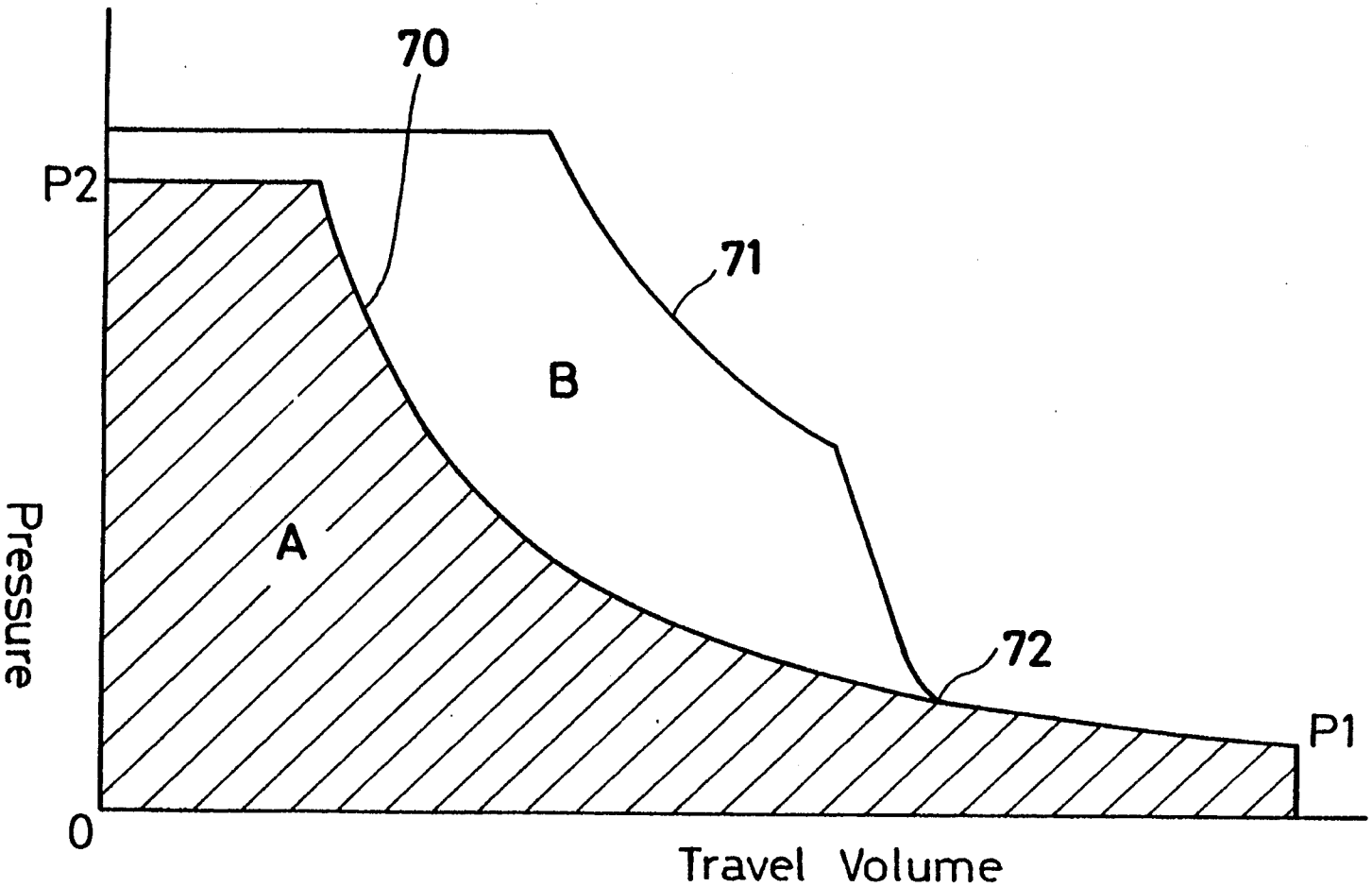
FIG. 5 is a Pressure-Volume diagram of the compressor shown in FIG. 1.

When the electric control unit 118 detects a decreasing of the heating capacity via thermostat 120, the electric control unit 118 controls to open the regulating valve 39. An opening ratio of the regulating valve 39 is regulated according to a ratio of the decreasing of the heating capacity. When the electric control unit 118 does not detect decreasing of the heating capacity, the regulating valve 39 is completely closed. As a result, one part of the vapor refrigerant discharged from the compressor 12 is injected to the injection ports 29,30 via the first injection path 32 and the second injection path 40. When a superheating ratio of the injected vapor refrigerant is in excess, a temperature of the vapor refrigerant discharged from the compressor 12 is also in excess. To prevent this phenomenon, the temperature detecting tube 41 detecting the superheating ratio of the injected vapor refrigerant regulates the opening ratio of the second expansion valve 42. Therefore, a proper quantity of the liquid refrigerant is mixed with the vapor refrigerant, and the refrigerant having a proper temperature and a proper pressure is injected to the injection ports 29,30. As a result, a temperature of the vapor refrigerant discharged from the compressor 12 increases, so that a quantity of the heat radiation from the refrigerant to the indoor air increases. Referring to FIG. 5, the refrigerant is injected to the injection ports 29,30 at the point 72. The work load of the compressor 12 is shown at portion "A+B", and a Pressure-Volume relationship in this condition is shown at line 71. That is, the work load increases. Thus, the load of the engine 50 increases according to the increasing of the work load of the compressor 12, and a temperature of the coolant increases, so that a quantity of the heat radiation from the hot coolant to the indoor air at the hot coolant heat exchanger 57 increases. Thus, the heating capacity of the air conditioner 10 increases, and the air conditioner 10 is able to have a high heating capacity. Here, the throttle opening ratio of the engine 50 increases according to increasing of the load thereof. However, the throttle opening ratio of the engine 50 is regulated to prevent the load of the engine 50 from becoming greater than the maximum load of the engine 50 in such a manner that the electric control unit 118 detects the throttle opening ratio of the engine 50 via the throttle opening ratio sensor 121.

Figure 6:
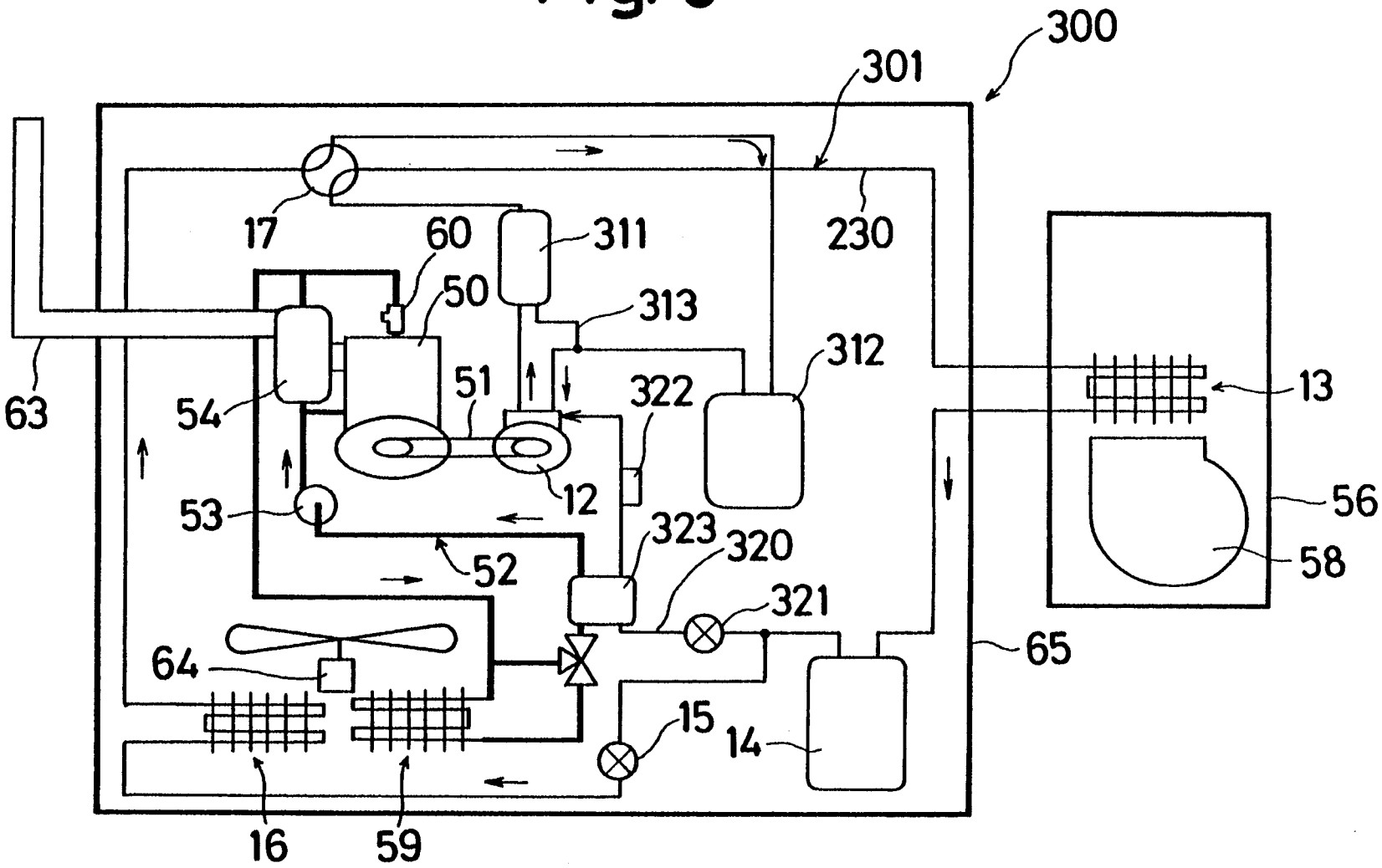
FIG. 6 shows a heat pump circuit and a coolant circuit of an air conditioner according to a second embodiment of the invention.
Figure 7:
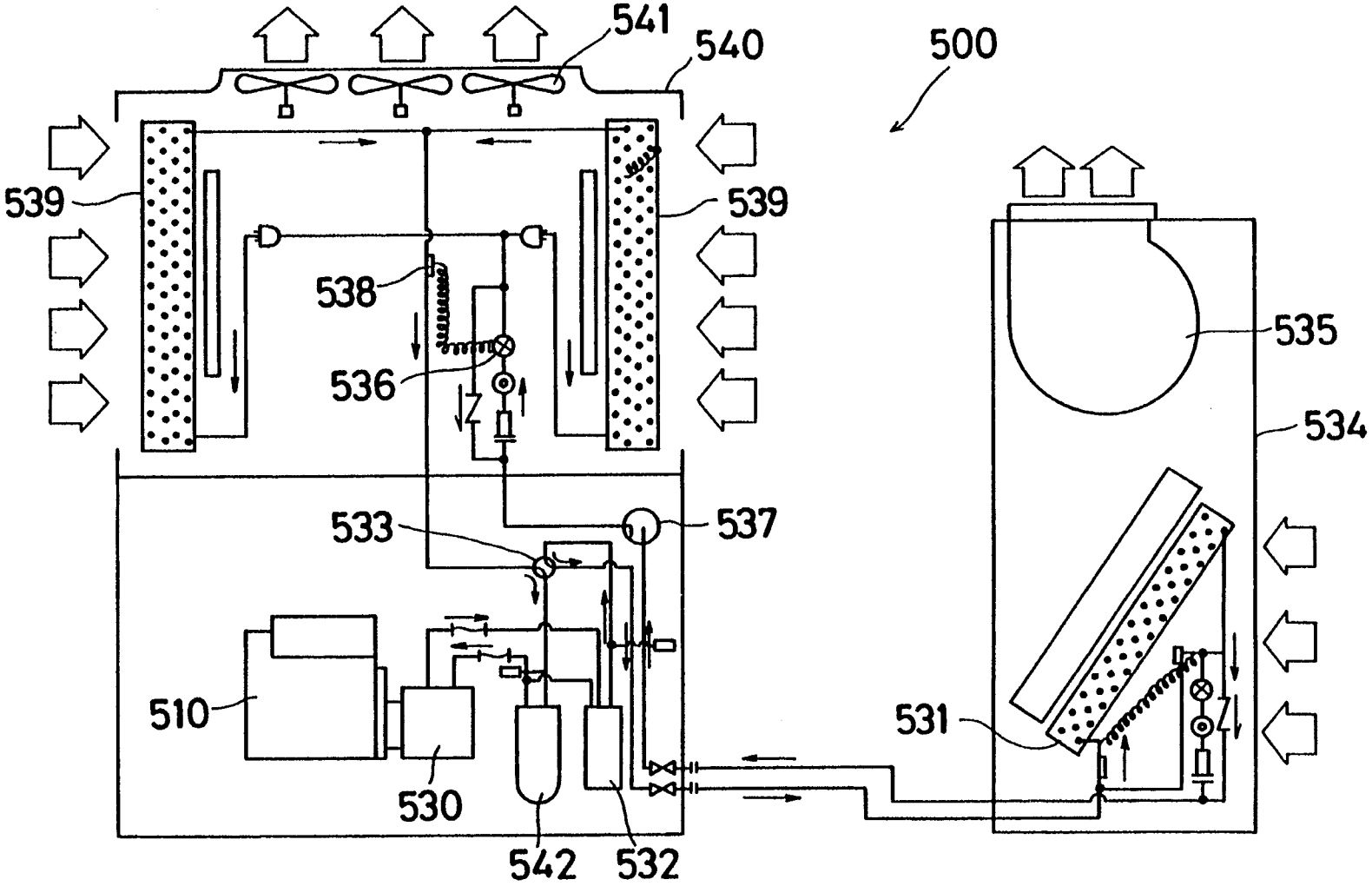
Fig. 7 (PRIOR ART)
FIG. 7 is a heat pump circuit of a conventional air conditioner.
Figure 8:
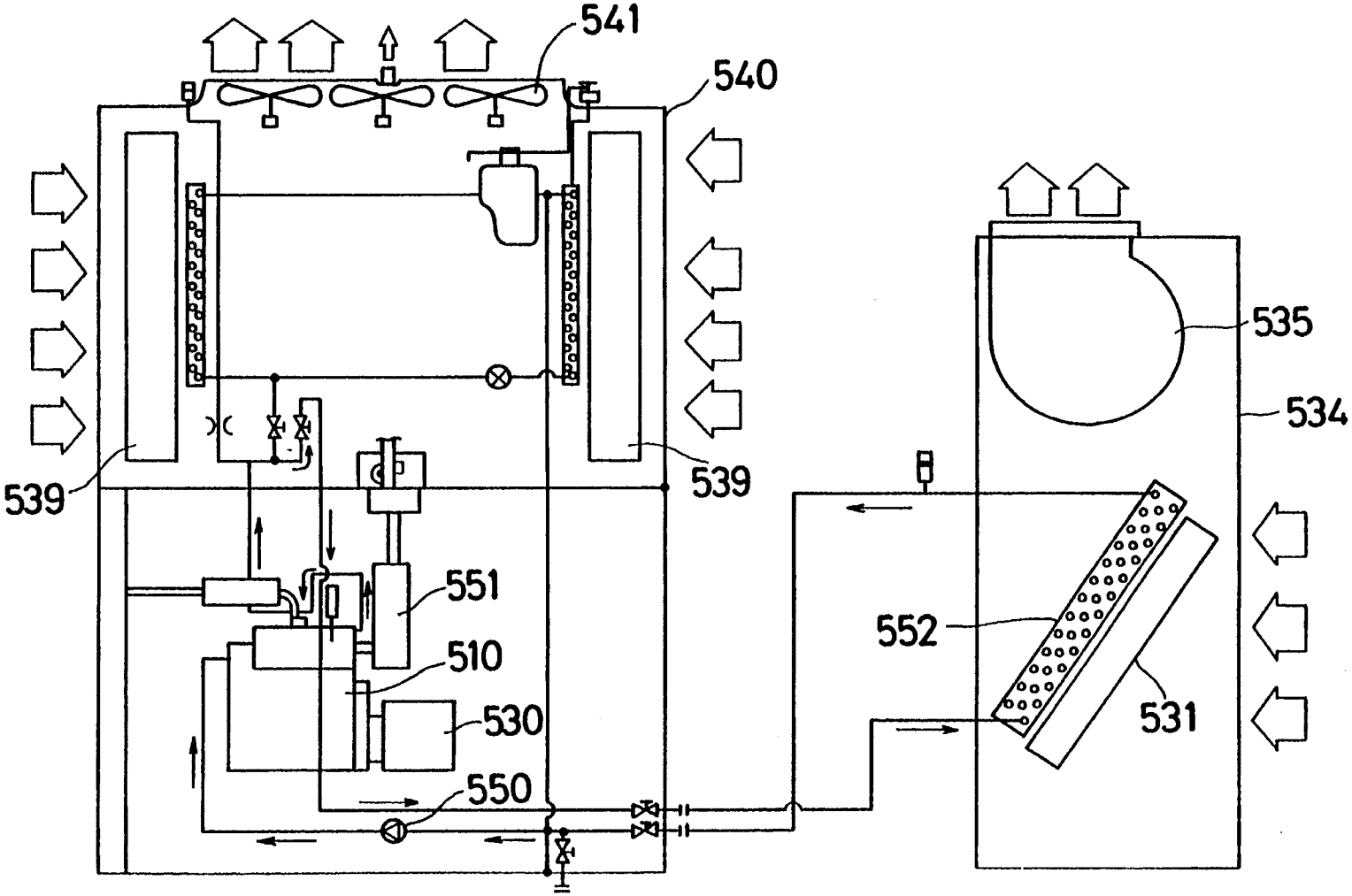
Fig. 8 (PRIOR ART)
FIG. 8 is a coolant circuit of an engine of the conventional air conditioner.

Next, referring to FIG. 6, an air conditioner 300, according to a second embodiment of the present invention is shown. In the second embodiment, the portions similar to the first embodiment will not be described and are indicated by the same reference numerals used to describe the first embodiment. In the second embodiment, the bridge 18 is omitted. FIG. 6 shows a heating mode of the air conditioner 300. Although the air conditioner 300 can function in both the heating mode and a cooling mode, the subject matter of the present invention relates to the heating mode. Therefore, the following description is directed to the heating mode only.

A heat pump circuit 301 of the air conditioner 300 includes an oil separator 311 and an accumulator 312. Oil separated in the oil separator 311 is returned to the suction ports 19,33 via an oil returning pipe 313. These components may be omitted from the first embodiment. A third injection path 320 connects the receiver 14 and the injection ports 29,30. A third expansion valve 321 is located in the third injection path 320. The third expansion valve 321 is similar to the regulating valve 39. An opening ratio of the third expansion valve 321 is regulated according to a superheating ratio of the refrigerant detected by a third detecting means 322. A temperature detecting tube or a temperature sensor may be used as the third detecting means 322. A hot coolant heat exchanger 323 is located in the coolant circuit 52 and the third injection path 320.

Only the operation of the second embodiment that differs from that of the first embodiment will be described. The third expansion valve 321 is always opened in spite of the outdoor temperature. Because heat from the coolant and heat from the exhaust gas are used to increase the heating capacity via the hot coolant heat exchanger 323. An opening ratio of the third expansion valve 321 increases according to an increased of a required heating capacity. However, the opening ratio of the third expansion valve 321 is carefully regulated under conditions of the superheating ratio of the refrigerant detected by the third detecting means 322 and the throttle opening ratio of the engine 50.

At the third injection path 320, the liquid refrigerant flows through the third expansion valve 321, and the liquid refrigerant expands and changes into the liquid and vapor refrigerant which is under a low pressure and at a low temperature. Next, the liquid and vapor refrigerant flows into the hot coolant heat exchanger 323. Here, heat exchange between the liquid and vapor refrigerant and the hot coolant is established, so that heat is transferred from the hot coolant to the refrigerant, and the liquid and vapor refrigerant evaporates completely. This complete evaporation of the liquid and vapor refrigerant is ensured by the regulation of the opening ratio of the third expansion valve 321. After that, the vapor refrigerant is injected into the compressor 12 via the injection ports 29,30.

Obviously, numerous modifications and variations of the present invention are possible in light of the above teachings. It is therefore to be understood that within the scope of the appended claims, the invention may be practiced otherwise than as specifically described herein.

What is claimed is:

1. An air conditioner having a heating capacity, comprising:

a heat pump circuit having a compressor, an indoor heat exchanger, a receiver which is located downstream of the indoor heat exchanger, an expansion valve, and an outdoor heat exchanger;

the compressor being driven by an engine and having a suction port, a discharging port, and an injection port;

detecting means for regulating an opening ratio of the expansion valve;

refrigerant circulating in the heat pump circuit;

injection means for injection one part of the refrigerant into the injection port;

a coolant circuit of the engine;

coolant circulating in the coolant circuit;

a coolant heat exchanger for transferring heat from the coolant to the refrigerant prior to injecting the refrigerant into the injection port; and an indoor unit, said indoor unit including the indoor heat exchanger and the coolant heat exchanger to facilitate heat exchange between indoor air and refrigerant flowing through said indoor heat exchanger and between indoor air and coolant flowing through said coolant heat exchanger.

2. An air conditioner having a heating capacity as set forth in claim 1, wherein the indoor heat exchanger and the hot coolant heat exchanger are located in the indoor unit, and the injection means comprises:

a first injection path connecting a diverging point on the heat pump circuit and the injection port;

a regulating valve located in the first injection path;

a second injection path connecting the receiver and a connecting point on the first injection path;

a second expansion valve located in the second injection path; and a second detecting means regulating an opening ratio of the second expansion valve and located on the first injection path, wherein the diverging point locates between the discharging port and the indoor heat exchanger, and the connecting point locates at an upstream side of the second detecting means.

3. An air conditioner having a heating capacity as set forth in claim 1, wherein the injection means comprises a second injection path connecting the receiver and the injection port, a third expansion valve located in the second injection path, and a third detecting means regulating an opening ratio of the third expansion valve and located at a downstream side of the expansion valve on the second injection path, wherein the coolant heat exchanger is located between the third expansion valve and the third detecting means in the second injection path.

4. An air conditioner having a heating capacity as set forth in claim 1, wherein the injection port is located in a spot where the injection port opens after a suction process has been completed.

5. An air conditioner having a heating capacity as set forth in claim 1, wherein the compressor has vanes, and a diameter of the injection port is smaller than a width of each of the vanes.

6. An air conditioner having a heating capacity, comprising:

a heat pump circuit having a compressor, an indoor heat exchanger, a receiver which is located downstream of the indoor heat exchanger, a first expansion valve, and an outdoor heat exchanger;

the compressor being driven by an engine and having a suction port, a discharging port, an injection port, a rotor and vanes, wherein the injection port is located in a spot where the injection port begins to open just after the suction process has been completed, and a diameter of the injection port is smaller than a width of each of the vanes;

first detecting means for regulating an opening ratio of the first expansion valve;

refrigerant circulating in the heat pump circuit;

injection means for injecting one part of the refrigerant into the injection port;

a coolant circuit of the engine; and a coolant circulating in the coolant circuit;

a coolant heat exchanger for transferring heat from the coolant to the refrigerant prior to injecting the refrigerant into the injection port.

7. An air conditioner having a heating capacity as set forth in claim 6, wherein the indoor heat exchanger and the hot coolant heat exchanger are located in an indoor unit, and the injection means comprises a first injection path connecting a diverging point on the heat pump circuit and the injection port;

a second injection path connecting the receiver and a connecting point on the first injection path;

a second expansion valve located in the second injection path; and second detecting means for regulating an opening ratio of the second expansion valve and located on the first injection path, wherein the diverging point is located between the discharging port and the indoor heat exchanger, and the connecting point is located at an upstream side of the second detecting means.

8. An air conditioner having a heating capacity as set forth in claim 6, wherein the injection means comprises a second injection path connecting the receiver and the injection port;

a third expansion valve located in the second injection path; and third detecting means regulating an opening ratio of the third expansion valve and located at a downstream side of the third expansion valve on the second injection path, wherein the coolant heat exchanger is located between the third expansion valve and the third detecting means in the second injection path.

* * * * *